United States Patent [19]

Sowers

[11] Patent Number: 4,914,554

[45] Date of Patent: Apr. 3, 1990

[54] PHOSPHORESCENT KEYHOLE LOCATOR

[75] Inventor: David A. Sowers, Coral Springs, Fla.

[73] Assignee: BSD Enterprises, Inc., Pompano Beach, Fla.

[21] Appl. No.: 237,327

[22] Filed: Aug. 29, 1988

[51] Int. Cl.[4] ..... E05B 17/10

[52] U.S. Cl. ..... 362/100; 362/84; 70/455; 250/466.1

[58] Field of Search ..... 362/84, 95, 100; 70/452, 455; 250/462.1, 466.1

[56] References Cited

U.S. PATENT DOCUMENTS

| | | | |
|---|---|---|---|
| 1,243,518 | 10/1917 | Harvey | 362/100 |
| 2,617,290 | 11/1952 | Schwartz | 70/452 |
| 2,658,151 | 11/1953 | Heinz | 250/466.1 |
| 2,729,749 | 1/1956 | Heinz | 250/466.1 |
| 3,307,030 | 2/1967 | DeFrancisco | 362/95 |
| 4,425,600 | 1/1984 | Barnhart | 362/84 |
| 4,539,625 | 9/1985 | Bornstein et al. | 362/84 |
| 4,600,974 | 7/1986 | Lew et al. | 362/102 |

FOREIGN PATENT DOCUMENTS

| | | | |
|---|---|---|---|
| 341674 | 1/1931 | United Kingdom | 250/466.1 |

*Primary Examiner*—Stephen F. Husar
*Attorney, Agent, or Firm*—John H. Faro

[57] ABSTRACT

A phosphorescent keyhole locator particularly adapted for use in combination with a tumbler-type lock comprising a cylindrical tumbler having a circular tumbler end surface with a keyhole therein, and a peripheral end surface around the tumbler end surface. A solid phosphorescent plastic body having an aperture therethrough is adhesively attached to the peripheral end surface with the aperture positioned over the tumbler end surface. The aperture is at least about as large as the tumbler end surface and has straight sides which may be normal to or bevelled towards the tumbler end surface.

10 Claims, 1 Drawing Sheet

FIG. 1
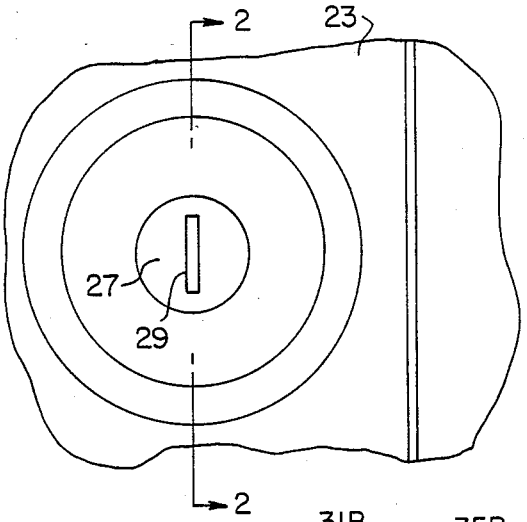
FIG. 2
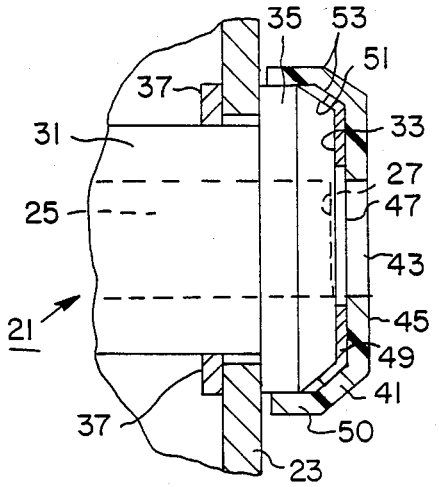
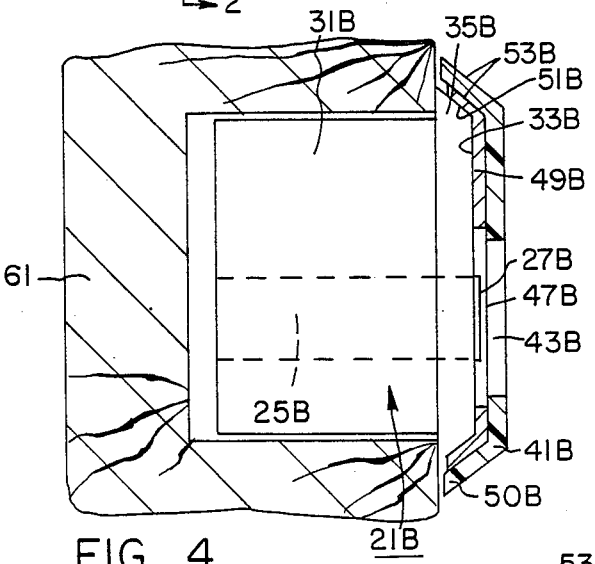
FIG. 4
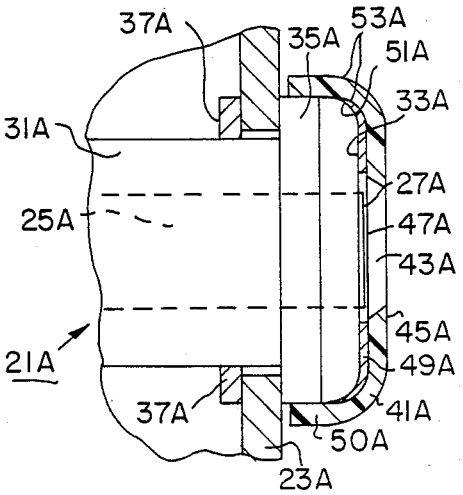
FIG. 3
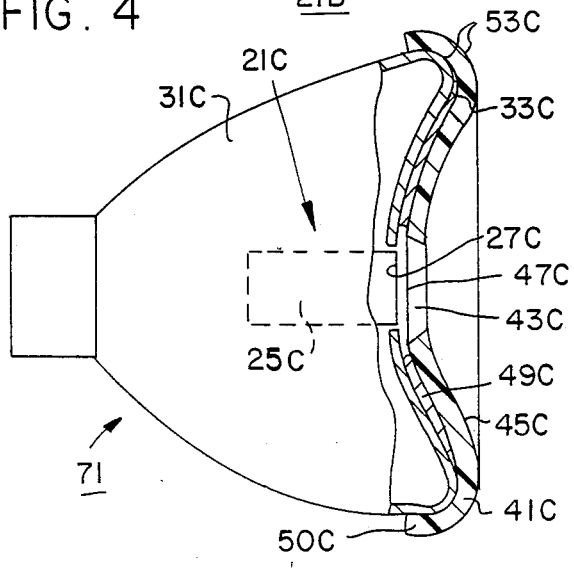
FIG. 5

PHOSPHORESCENT KEYHOLE LOCATOR

BACKGROUND OF THE INVENTION

1. Field of the Invention

This invention relates to a novel phosphorescent keyhole locator in combination with a tumbler-like lock and to the keyhole locator itself.

2. The Description of the Prior Art

A common problem in modern society is to locate the keyhole of a lock in both lighted places and, especially, in dark places. The lock may be in the door of an automobile, in the door of a building, in a door handle, in a filing cabinet, etc. A tumbler-type lock, which may be of the lever-type, disc-type, or pin-type, is the most common type of lock used today. These locks include a tumbler portion having an external circular tumbler end surface which has a keyhole therein. This lock also includes a peripheral portion having an external peripheral end surface around the tumbler end surface.

A keyhole is quite small and the proper key for the keyhole must be properly oriented with respect to the keyhole to slide the key into the keyhole. To assist in finding the keyhole and to properly insert the key therein, various illuminators have been suggested previously. For example, U.S. Pat. No. 4,234,909 to P. R. Cotroneo describes an illuminator for the door lock of an automobile including an electric lamp, wires to a power source, a switch and a plastic plate to distribute light from the lamp to the keyhole. U.S. Pat. No. 3,719,821 to L. Foreman describes an illuminator attachment for a door knob comprising a lamp, a switch, a battery, wires connecting the lamp to the battery and a light port to guide light from the lamp to a keyhole in the door knob. These patents, and patents cited therein, all describe devices which need a source of electric power, a switch, wiring, and other structures. In addition, these prior devices require maintenance after they have been installed.

The prior art also describes phosphorescent materials; that is, materials which emit visible light for many hours after they have been exposed to visible light. These materials are to be distinguished from other luminescent materials which need to be excited with ultraviolet light, or cathode rays, or the like, and continue to emit for only a short time after excitation has stopped, usually for minutes or fractions of a minute. Devices employing phosphorescent materials are described in U.S. Pat. No. 3,978,340 to B.J. Schroeder for a backing sheet; U.S. Pat. No. 4,242,831 to J.F. O'Shaughnessy for a toy; U.S. Pat. No. 4,360,557 to J. A. Miller for a stair tread; U.S. Pat. No. 4,401,050 to L.D. Britt et. al. for a sign; and U.S. Pat. No. 4,629,583 to P.J. Gognan for shoe parts. None of these prior uses of phosphorescent materials is adapted to aid in locating the keyhole of a lock.

OBJECTS OF THE INVENTION

An object of the invention is to provide a novel phosphorescent keyhole locator, and to novel combination of the novel keyhole locator with a tumber-type lock.

Another object is to provide a novel phosphorescent keyhole locator that requires little or no maintenance after the device has been installed.

A further object is to provide a novel device that aids in locating a keyhole, both by sight and by feel, under both lighted and dark conditions, and to the combination of the novel device with a tumbler-type lock.

Still another object is to provide a novel keyhole locator that is low in cost, both to fabricate and to install.

SUMMARY OF THE INVENTION

These and other objects can be realized with the novel device which is particularly adapted for use in the novel combination with a tumbler-type lock comprising a cylindrical tumbler portion having an external circular tumber end surface and a keyhole in the tumbler end surface, and a peripheral portion having an external peripheral end surface around the tumbler end surface.

The novel device comprises a solid phosphorescent plastic body having a substantially circular aperture therethrough. The diameter of the circular aperture is at least about as large as the diameter of the tumbler end surface. The plastic body has a front surface and a back surface, which the back surface carries a coating of adhesive for attachment to the peripheral end surface of the lock.

The novel combination comprises the plastic body adhesively attached to the peripheral end surface with the aperture positioned over the tumbler end surface. In the preferred forms of the invention, the back surface of the plastic body substantially conforms to the shape of the peripheral end surface. After the plastic body is adhered to the peripheral end surface, little or no maintenance is required for the device or the novel combination.

The plastic body will glow for hours after it is exposed to ambient light. Thus, in darkness or semi-darkness a ring of light around the keyhole will identify its location. In addition, light transmitted through the edge of the aperture will be cast on the keyhole and can aid in properly orienting the key just prior to sliding it into the keyhole. Since the aperture stands out over the tumber end surface, the user can feel its location also, and this can be used as a further guide. The novel device can be provided in various colors to identify particular locks, and keys, therefore, can be similarly color coded.

BRIEF DESCRIPTION OF THE DRAWINGS

FIG. 1 is an elevational view of a fragment of the door of a motor vehicle, showing a first embodiment of the novel device in combination with the door lock of the vehicle.

FIG. 2 is a sectional view of the first embodiment shown in FIG. 1, viewed along section line 2—2.

FIG. 3 is a sectional view of a second embodiment of the novel device in combination with the door lock of a second motor vehicle.

FIG. 4 is a sectional view of a third embodiment of the novel device in combination with the outside door lock for a building door.

FIG. 5 is a sectional view of a fourth embodiment of the novel device in combination with a door handle.

DETAILED DESCRIPTION OF THE INVENTION INCLUDING THE PREFERRED EMBODIMENTS

The following description of some of the preferred embodments of the concepts of this invention is made in reference to the accompanying figures. Where an individual structural element is depicted in more than one figure, it is assigned a common reference numeral for simplification of identification and understanding.

The first embodiment of the novel device, shown in FIGS. 1 and 2, is shown in combination with a first door lock (21) in the door (23) of the first motor vehicle. The first door lock (21) includes a cylindrical tumbler (25) having an external circular tumbler end surface (27), which tumbler end surface (27) has a keyhole (29) therein. The first door lock (21) includes also a peripheral portion (31) having an external peripheral end surface (33) around the tumbler end surface (27). The first lock (21) is held in place by a lock flange (35) on the peripheral portion (31) and by a U-shaped clip (37). The novel device includes a first solid phosphorescent plastic body (41) of substantially uniform thickness and having a substantially circular body aperture (43) therein. The first body (41) has a front body surface (45) and a back body surface (47). A layer (49) of adhesive attaches the back body surface (47) to the peripheral end surface (33) with rhe aperture (43) over the tumbler end surface (27). The diameter of the body aperture (43) is about as large as the diameter of the tumbler end surface (27), thereby permitting adequate clearance for a key to enter the keyhole (29) and to rotate with the tumbler (25) when the lock is opened. The body aperture (43) has a straight aperture wall which is about normal to the front and back surfaces (45 and 47) of the body (41).

The first body (41) consists essentially of a light-transmitting plastic, such as an acrylic plastic or a polyethylene plastic, containing a phosphorescent dye therein. Instead of the dye, particles of a phosphorescent material may be dispersed in the plastic. Examples of suitable phosphorescent dyes and phosphorescent particles are disclosed in the above-cited patents describing phosphorescent devices. In all cases, the plastic functions as a binder and carrier for the phosphorescent dye or particles. In addition, the plastic is a transmitter of the glow; that is, the phosphorescent light emitted by the phosphorescent dye or particles, within the body (41). Also, the plastic is a transmitter of ambient light into the body (41) that stimulates the phosphorescent material to glow. The first body (41) may be tinted in one of several colors, if desired.

The plastic body (41) is provided with a layer of adhesive on the back body surface (47). For installation, the plastic body needs only to be oriented properly over the lock and pressed into place. Alternatively, the adhesive may be separate from the plastic body (41) and applied by the user just prior to installation. After installation, little or no maintenance is required.

Ambient light, particularly daylight, stimulates the plastic body to phosphorescence, which will provide a practical brightness for at least twelve hours, gradually becoming dimmer with time. Some phosphorescent light escapes from the front body surface (45) providing a ring of light around the keyhole, which is easily seen in the dark, and may serve to identify the users vehicle. Some phosphorescent light escapes through the body aperture wall (43) and illuminates the tumbler end surface (27) and the keyhole (29). As shown in FIG. 2, the plastic body (41) includes a peripheral body flange (50) which is pressed fit around the lock flange (35).

The first embodiment (21), shown in FIG. 2, shows a peripheral portion (31) having a lock flange (35) with a beveled lock corner (51). The first plastic body (41) has beveled body corners (53) to conform with the shape of the beveled lock corners (51). The second embodiment (21A), shown in FIG. 3, is similar to the first embodiment (and similar structures have similar reference numerals followed by the letter A), except that the lock flange (35A) has a rounded or arcuate lock corner (51A) and the second body corners (53A) of the second plastic body (41A) are rounded to conform with the shape of the rounded lock corner (51A). Also, in the second embodiment (21A), the second body aperture (43A) as a straight wall that is beveled to face toward the back body surface (47A). Beveling the second aperture wall (43A) throws somewhat more light towards the tumbler end wall and the keyhole therein.

The third embodiment (21B), shown in FIG. 4, is similar to the first embodiment (21) (and similar structures have similar reference numerals followed by the letter B), except that the tumbler-type lock (21B) is for an external door (61) to a building, which lock (21B) has a tumbler (25B) that is offset from the center of the peripheral portion of the cylinder (31B). Accordingly, in the third plastic body (41B), the third body aperture (43B) is offset from the center of the body (41B) to conform to the third tumbler and peripheral end surfaces (27B) and (33B), respectively. Also, the third body aperture (43B) is considerably larger than the third tumbler end surface (27B), because keys for such door locks usually have outwardly-extending key stops (not shown) which require additional clearance when the key (not shown) is rotated with the tumbler (25B).

The fourth embodiment shown in the FIG. 5 is the combination of a fourth plastic body (41C) with a door knob (71), which is the peripheral portion (31C) of the lock (21C). The door knob (71) includes a fourth peripheral end surface (33C) surrounding the fourth tumbler end surface (27C) of a fourth cylindrical tumbler (25C). Otherwise, the fourth embodiment is similar in structure to the second embodiment (and similar structures have similar reference numerals followed by the letter C).

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. In combination, a tumbler-type lock having a keyhole and means for locating the keyhole of said lock, said tumbler-type lock comprising a cylindrical tumbler portion having an external circular tumbler end surface, said tumbler end surface having a keyhole therein, and a peripheral portion having an external peripheral end surface around said tumbler end surface, said locating means comprising a solid phosphorescent plastic body having a substantially circular open, unobstructed aperture therethrough, said body having a front body surface and a back body surface, said back body surface being adhesively attached directly to said peripheral end surface with said aperture positioned over said tumbler end surface, the diameter of said aperture being about as large as the diameter of said tumbler end surface, said aperture having unobstructed sides which are adapted to pass phosphorescent light from said plastic body for illuminating said tumbler end surface and said keyhole.

2. The combination recited in claim 1 wherein said phosphorescent plastic body consists essentially of a light-conducting organic polymeric material having a phosphorescent dye dissolved therein.

3. The combination recited in claim 1 wherein said phosphorescent plastic body consists essentially of a light-conducting organic polymeric material having phosphorescent particles dispersed therein.

4. The combination recited in claim 1 wherein said phosphorescent plastic body has a substantially uniformed thickness and said aperture has straight sides.

5. The combination recited in claim 4 wherein the sides of said aperture are beveled to face toward said back body surface.

6. The combination recited in claim 1 wherein said back body surface substantially conforms in shape with said peripheral end surface.

7. The combination recited in claim 1 wherein said tumbler end surface is substantially flat, said peripheral end surface is arcuate and said front and back body surfaces conform substantially with said arcuate peripheral end surface.

8. A device for locating the keyhole of a tumbler-type lock, said lock comprising a cylindrical tumbler portion having an external circular tumbler end surface, said tumbler end surface having a keyhole therein, and a peripheral portion having an external peripheral end surface around said tumbler end surface, said device comprising a solid phosphorescent plastic body having a substantially circular, open, unobstructed aperture therethrough, said body having a front body surface and a back body surface, said back body surface carrying a coating of adhesive for attachment directly to said peripheral end surface, the diameter of said aperture being about as large as large as the diameter of said tumbler end surface, said aperture having unobstructed sides which are adapted to pass phosphorescent light from said plastic body for illuminating said tumbler end surface and said keyhole.

9. The device defined in claim 8 wherein said phosphorescent plastic body consists essentially of a light conducting organic polymeric material having a phosphorescent dye dissolved therein.

10. The device defined in claim 8 wherein said phosphorescent plastic body consists essentially of a light conducting organic polymeric material having phosphorescent particles dispersed therein.

* * * * *